US006734875B1

(12) United States Patent
Tokimoto et al.

(10) Patent No.: US 6,734,875 B1
(45) Date of Patent: May 11, 2004

(54) FULLCOLOR LED DISPLAY SYSTEM

(75) Inventors: Toyotaro Tokimoto, Yokohama (JP); Masatoshi Ohishi, Zushi (JP)

(73) Assignee: Avix, Inc., Yokohama (JP)

( * ) Notice: Subject to any disclaimer, the term of this patent is extended or adjusted under 35 U.S.C. 154(b) by 0 days.

(21) Appl. No.: 09/937,203

(22) PCT Filed: Mar. 24, 2000

(86) PCT No.: PCT/JP00/01832

§ 371 (c)(1),
(2), (4) Date: Dec. 27, 2001

(87) PCT Pub. No.: WO00/57397

PCT Pub. Date: Sep. 28, 2000

(30) Foreign Application Priority Data

Mar. 24, 1999 (JP) ..... 11/79663
Mar. 30, 1999 (JP) ..... 11/88234

(51) Int. Cl.[7] ..... G09G 5/10
(52) U.S. Cl. ..... 345/690; 345/82; 345/83
(58) Field of Search ..... 345/82, 83, 204, 345/690–693, 208, 213, 98

(56) References Cited

U.S. PATENT DOCUMENTS 5,184,114 A * 2/1993 Brown ..... 345/83
5,668,568 A * 9/1997 Holloman ..... 345/83
5,708,452 A * 1/1998 Takahashi ..... 345/82
5,717,417 A * 2/1998 Takahashi ..... 345/82
6,016,132 A 1/2000 Takahashi
6,288,696 B1 * 9/2001 Holloman ..... 345/84

FOREIGN PATENT DOCUMENTS

EP 0 702 347 3/1996
EP 0 936 596 8/1999
GB 2 210 720 6/1989
JP 59-158617 9/1984
JP 62-43689 2/1987
JP 1-209493 8/1989
JP 4-241384 8/1992
JP 5-249920 9/1993
JP 05 273939 10/1993
JP 7-306659 11/1995
JP 7-311560 11/1995
JP 8-185139 7/1996

OTHER PUBLICATIONS

Chinese Office Action dated Nov. 7, 2003 in Chinese Application No. 00806668.X (and translation).

* cited by examiner

*Primary Examiner*—Kent Chang
(74) *Attorney, Agent, or Firm*—Collard & Roe, P.C.

(57) ABSTRACT

A system has a screen module for displaying multicolor images on a screen having orderly-arrayed first, second, and third color LEDs, and a data-sending module sending control signals and image data to be displayed. The screen module has first, second, and third color gradation-control circuits for each pixel. The data-sending module comprises: a frame memory for temporarily storing image data; an image-data transfer controller for reading out image data from the memory and outputting it with a data-transfer clock; first, second, and third color pulse-train generators for generating high-speed pulse trains to be given to each gradation-control circuit; and a pulse-train outputting means for outputting the pulse trains for each color. Each pulse-train generator generates, with a constant period, pulse trains of $2^n$ pieces or a number closely therebelow, pulse intervals varying with time according to a preset characteristic.

6 Claims, 7 Drawing Sheets

FULLCOLOR LED DISPLAY SYSTEM

CROSS REFERENCE TO RELATED APPLICATIONS

Applicants claim priority under 35 U.S.C. §119 of Japanese Application Nos. 11/79663, filed on Mar. 24, 1999 and 11/88234, filed on Mar. 30, 1999. Applicants also claim priority under 35 U.S.C. §120 of PCT/JP00/01832, filed ON Mar. 24, 2000. The international application under PCT article 21(2) was not published in English.

TECHNICAL FIELD

The present invention relates to a fullcolor LED display system displaying gradation-rich, multicolor images by combining, for example, LED lamps of three primary colors of RGB (red, green and blue). Particularly, the invention relates to a system of pulse-width modulation method for lighting and activating an LED lamp by an activating pulse having been pulse-width modulated based on gradation data for each color.

BACKGROUND ART

Basic Structure of Fullcolor LED Display System

Following the development of high-luminance blue LEDs (light-emitting diodes), fullcolor LED display systems, combining the three primary colors RGB, are beginning to become popular. An example of a specification of a typical device is as below. A display screen is in a large size of 2.4 meters in height and 3.4 meters in width. A total of 61,440 pixel lamps of 480 lines vertically and 128 dots laterally are arrayed in this screen. Each of the pixel lamps is an LED-multicolor-assembled lamp in which respective LEDs in the three primary colors RGB are densely gathered. Pixel data for driving one pixel consists of a total of 24 bits, that is 8 bits respectively for each RGB. The displaying gradation for each of the colors RGB is 256 tones respectively, and thus, a fullcolor expression of 16,777,216 colors is made possible.

In this type of fullcolor LED display system, it is possible to use, as its video source, an NTSC video signal used in a regular television broadcasting system or a VTR. An NTSC video signal having been input to a display-control device is A/D converted, and is converted and processed into digital signals of a total of 24 bits of 8 bits respectively for RGB. Image data for one screen, containing (61,440×24) bits corresponding to the 61,440 pixel lamps, is buffered in a frame memory. From this frame memory, image data of 24 bits for a single pixel is respectively distributed to a activating circuit of each pixel lamp, and is latched to a register in the activating circuit.

In the pixel-lamp activating circuit, the red LEDs are activated and lit at a tone corresponding to the 8 bits of red data latched in the register. Similarly, the green LEDs are activated and lit at a tone corresponding to the 8 bits of green data, and the blue LEDs are activated and lit at a tone corresponding to the 8 bits of blue data.

Gradation Control With Pulse-Width Modulation Method

Such a gradation control is generally conducted by a known pulse-width modulation method. A clock pulse of a sufficiently-high constant frequency is continuously generated; a $(2^8)$=8-bit counter is incremented by the clock pulse; and an 8-bit count value of the counter is repetitively changed at a constant period Ts from all "0" to all "1". By comparing, with a digital comparator, the magnitude between this 8-bit calculated value and the 8-bit gradation data latched in the register of the activating circuit, an activating pulse with a pulse width Tw corresponding to the 8-bit gradation data and with the above-mentioned period Ts is output from the comparator. The pixel-lamp activating circuit feeds a constant current through the LED and lights it for a time period of the pulse width Tw of the activating pulse. This pulse lighting is repeated at period Ts.

That is, the pulse width Tw of the activating pulse with a period Ts is determined proportional to the binary value of the 8-bit gradation data, and a displaying luminance corresponding to the 8-bit gradation data is obtained by pulse-lighting the LED with a constant current for time Tw during period Ts.

Gamma Correction of TV Signals

Even nowadays, the mainstream television-image display devices are CRT television sets. Since the RGB three-colored fluorescent materials of the CRT television sets do not illuminate in proportion to the voltage of the input video signal, the relation between the input signal and the optical output is nonlinear. As well known, such a characteristic is referred to as GAMMA. If the nonlinearity (gamma) of the CRT is corrected at each television set, the television set becomes complicated and expensive. Thus, in the current television method, signals having been gamma-corrected at the sending side are broadcasted. The actual gamma value becomes a quite different value according to measuring conditions and measuring methods. In the NTSC method, gamma correction is conducted assuming that the gamma value of the image-display device is 2.2.

However, in an LED display system, the relation between the input signal and the optical output is approximately linear, and is not nonlinear as of a gamma of a CRT television set. The relation is not completely nonlinear, but the characteristic is significantly different from the gamma of a CRT.

If a gamma-corrected NTSC video signal is taken as a video source of an LED display system, it would be necessary to carry out an inverse-gamma correction with means of some kind and carry out gradation control according to the approximately-linear characteristic of the LED, if a high-quality image displaying were to be realized.

Gradation Control by Nonlinear Pulse-Width Modulation

In a Japanese Patent Application Laid-open Publication (No. 7-306659) issued in 1995, a technique as follows was disclosed concerning a multicolor LED display unit:

(1) An LED display unit (screen) is formed by orderly arraying a multitude of LEDs in the three primary colors RGB. An LED lighting circuit for lighting each of the LEDs and adjusting the lighting color and brightness thereof is installed to the unit.

(2) The LED lighting circuit comprises: a pulse-width modulation circuit which outputs an activating pulse corresponding to an inputted gradation data; and an LED activating circuit which lights the LED with the activating pulse from the pulse-width modulation circuit.

(3) The pulse-width modulation circuit comprises: a nonlinear counter in which the relation between time and a count value takes a nonlinear action; and a digital comparator which compares the magnitude between the count value of the nonlinear counter and the gradation data stored to a buffer memory to generate the aforementioned activating pulse.

(4) The nonlinear counter comprises: a pulse generator which generates a count pulse of 16 types, each having a different period; a selection circuit which selects one type of count pulse out of the 16 types; a binary counter which counts the count pulse having been selected by the aforementioned circuit; and a decoder circuit which generates a selection signal for selecting the 16 types of count pulses from the higher-order 4 bits of the binary counter.

(5) When the count value of the binary counter is small, the selection circuit has selected a count pulse having a short period according to the selection signal from the decoder circuit, and thus, the count value of the binary counter increases rapidly. When the count value of the binary counter becomes large, the selection signal from the decoder circuit changes, and the selection circuit selects a count pulse having a long period, and thus, the count value of the binary counter increases slowly.

(6) Gradation data is successively sent from an external device, such as a display controller, to the LED display system, and is temporarily stored in a memory. The gradation data stored in the memory is input to the digital comparator via the buffer memory. The pulse width Tw of the activating pulse which is output from the digital comparator is nonlinearly modulated in view of the gradation data; in a range where the gradation data is small, the rate of change of the pulse width Tw is small, and as the gradation data becomes large, the rate of change of the pulse width Tw becomes large.

In the conventional multicolor LED display unit as described-above, by adopting gradation control according to nonlinear-pulse-width modulation, in the case where a gamma-corrected NTSC video signal is taken as a video source, it is possible to carry out an inverse-gamma correction of a line-graph like approximation which matches the approximately linear characteristic of the LED, to carry out image displaying of a higher quality.

However, in this known technique, since an inverse-gamma correction of a line-graph like approximation is conducted, it is difficult to carry out an inverse-gamma correction of high quality with a simple circuit structure, and it is also difficult to realize a superior image quality of sufficient satisfaction. Further, since a circuit structure, which carries out gradation control by nonlinear pulse-width modification, is installed to the LED display unit, there were structural problems as described below when considering adaptation to an embodiment of particularly a large-screen LED display device.

In a downtown area of a city, there are seen many large-screen full-color LED displays installed on walls of buildings. In such a system, a configuration, wherein screen modules installed on such as a building wall is connected with data-sending modules arranged within a building room through data-transmission cables, is adopted. A screen module is equivalent to a required number of the LED display units of the aforementioned known document being connected together. A data-sending module is equivalent to what is represented as the external device such as the display controller in the aforementioned known document.

In the full-color LED display system as described above, it is desired to enhance image quality by optimizing a display-gradation-control characteristic through various factors, such as variably controlling, in a suitable manner, control characteristics of display tones according to gradation-expression characteristics (gamma-correction characteristic of a TV signal is one such characteristic) of an image data to be displayed, or, variably controlling, in a suitable manner, the control characteristics of display tones according to if it is daytime when sunlight is shining or nighttime when it is not.

In order to realize the aforementioned function, an optimization information for the display-gradation-control characteristic would be sent from the data-sending module (a computer for controlling display) which feeds image data to the screen module. In the known technique, the characteristic of the nonlinear counter, which is installed to the LED display unit (the structural component of the screen module), would be successively changed by a signal fed from the display controller (the data-sending module).

It is possible to realize such a circuit system. However, matters, such as what kind of signal is to be fed from the data-sending module to which part of the nonlinear counter in the multitude of LED display units structuring the screen module and how its characteristic is to be variably controlled, were not the theme of the invention disclosed in the aforementioned known document.

In the aforementioned known document, it is described that the pulse generator (generating the 16 types of count pulses), which is a structural component of the nonlinear counter, may be a program counter, and that its set value (a value for determining the respective periods of the 16 types of count pulses) can be optimized from an external point. From this description, it is possible to think of a control system which changes the set value of the pulse generator within the nonlinear counter in the multitude of LED display units structuring the screen module by signals from the data-sending module connected to the screen module through the data-transmission cable. However, in such a case, the control system would have a complicated and expensive circuit structure requiring a multitude of signal-sending lines. Even when adopting such a complicated and expensive circuit structure, it is only possible to carry out gradation control of the aforementioned line-graph-like characteristics, and to carry out an extremely limited characteristic change of modifying the slope of each of the line segments of the line graph.

A control system apart from the aforementioned type is to be considered. For example, in the aforementioned known technique, it is possible to think of a system configuration wherein: the pulse generator, which is a structural component of the nonlinear counter, is installed to the side of the data-sending module; and the count pulses of 16 kinds which are output from the pulse generator are transferred to the screen module through the data-transmission cable and are input to the selection circuit in the nonlinear counter. Then, in order to change the characteristic of the nonlinear counter, the characteristic of the pulse generator is variably set by the computer of the data-sending module, and the period of the 16 types of the count pulses is appropriately modified. However, alike the aforementioned system, this control system becomes a complicated and expensive circuit structure. Even when such a complicated and expensive circuit structure is adopted, it is only possible to carry out gradation control of the aforementioned line-graph-like characteristics, and to carry out an extremely limited characteristic change of modifying the slope of each of the line segments of the line graph.

DISCLOSURE OF THE INVENTION

An object of the present invention is to provide a system configuration which, in accordance to a gradation-expression characteristic of such as an NTSC video signal to be taken as a video source, can easily carry out suitable correction of such characteristic to adapt to the characteristic of an LED by means of a simple circuit system, and can carry out full-color image display of high quality, in a full-color LED display system which is system-configured from a screen module and a data-sending module.

First Invention

A fullcolor LED display system according to the first invention is specified by the following matters (11)–(17), wherein:

(11) the above comprises a screen module for displaying a multicolor image on a screen in which a multitude of first-color LEDs, second-color LEDs and third-color LEDs are orderly arrayed; and a data-sending module which gives a control signal and image data to be displayed on the screen module;

(12) the screen module and the data-sending module are connected by data-sending means;

(13) the image data is an assembly of gradation data for each colors of each pixels on the screen; and on the screen module, for each pixel on the screen, there are installed first-color gradation-control circuits, second-color gradation-control circuits and third-color gradation-control circuits for pulse-lighting the LEDs;

(14) the gradation-control circuit for each color comprises: an n-bit counter for counting high-speed pulse trains given from the data-sending module; a register for latching the gradation data given from the data-sending module; a digital comparator for comparing magnitude between an n-bit count value from the n-bit counter and the gradation data latched to the register; and a constant-current driver for turning ON and OFF a current-passing to the LED according to a binary output of the digital comparator;

(15) the data-sending module comprises: a frame memory for temporarily storing image data to be displayed on the screen module; an image-data-transfer-control means for reading out the image data from the frame memory, and for outputting, to the data-sending means, the image data along with a predetermined data-transfer clock in a predetermined pixel order; first-color high-speed pulse-train generating means, second-color high-speed pulse-train generating means, and third-color high-speed pulse-train generating means for generating high-speed pulse trains to be given to the respective first-color gradation-control circuit, second-color gradation-control circuit a nd third-color gradation-control circuit; and a high-speed pulse-train outputting means for outputting, to the data-sending means, the respective high-speed pulse trains for the respective first color, second color and third color;

(16) the data-sending means and the screen module comprise: a data-transfer-control system for latching the respective gradation data of each color of each pixel, having been outputted from the data-sending module, to the register in the gradation-control circuit for the corresponding color and the corresponding pixel; and a signal-transfer system for applying the first-color high-speed pulse trains, the second-color high-speed pulse trains and the third-color high-speed pulse trains, having been outputted from the data-sending module, as a count input to the n-bit counter in the gradation-control circuit of the corresponding color; and

(17) the high-speed pulse-train generating means for each color repetitively generate, with a constant period, high-speed pulse trains of ($2^n$) pieces or a number closely therebelow, of which pulse intervals vary with time according to a varying characteristic having been set.

Second Invention

A fullcolor LED display system according to the second invention is characterized in that:

the data-sending module comprises a single-system high-speed pulse-train generating system which is shared among process systems for the first color, second color and third color; and the data-sending means and the screen module comprise a signal-transfer system for applying the high-speed pulse trains of a single system, having been outputted from the data-sending module, as a count input of the n-bit counter in the gradation-control circuit of each color.

Third Invention

A fullcolor LED display system according to the third invention is specified by the following matters (21)–(28), wherein:

(21) the above comprises a screen module for displaying a multicolor image on a screen in which a multitude of first-color LEDs, second-color LEDs and third-color LEDs are orderly arrayed; and a data-sending module which gives a control signal and image data to be displayed on the screen module;

(22) the screen module and the data-sending module are connected by data-sending means;

(23) one pixel is formed of the first-color LED(s), the second-color LED(S) and the third-color LED(s) adjacently arranged on the screen; and in the screen module there is installed: one gradation-control circuit for pulse-lighting the first-color LED(s), the second-color LED(S) and the third-color LED(s) forming the same pixel; and a color-select circuit for selecting the first-color LED(s), the second-color LED (s) and the third-color LED(s) forming the same pixel;

(24) the image data is an assembly of gradation data for each color of each pixels on the screen;

one period for lighting and activating the LEDs according to the image data is divided into three of: a first-color activating period for lighting and activating the first-color LED(s) according to first-color gradation data; a second-color activating period for lighting and activating the second-color LED(s) according to second-color gradation data; and a third-color activating period for lighting and activating the third-color LED(S) according to third-color gradation data;

divided-time intervals of the first-color activating period, the second-color activating period and the third-color activating period are set to be a short time to an extent in which human sight cannot recognize that the three colors are lighted with a time difference;

(25) the gradation-control circuit comprises: an n-bit counter for counting high-speed pulse trains given from the data-sending module; a register for latching the gradation data given from the data-sending module; a digital comparator for comparing magnitude between an n-bit count value from the n-bit counter and the gradation data latched to the register; and a constant-current driver for turning ON and OFF a current-passing to the LED according to a binary output of the digital comparator; and first-color LED(s), second-color LED(s) and third-color LED(s) of the same pixel are connected in parallel to the constant-current driver via the color-select circuit;

(26) the data-sending module comprises: a frame memory for temporarily storing image data to be displayed on the screen module; an image-data-transfer-control means for reading out the image data from the frame memory, and for outputting, to the data-sending means, the image data along with a predetermined data-transfer clock in a predetermined pixel order; high-speed pulse-train generating means for generating high-speed pulse trains to be given to the gradation-control circuit; and means for outputting, to the data-sending means, the high-speed pulse trains;

(27) the high-speed pulse-train generating means orderly generates, with a constant period, high-speed pulse trains of ($2^n$) pieces or a number closely therebelow, of which pulse intervals vary with time according to a varying characteristic having been set according to color in the respective first-color activating period, the second-color activating period and the third-color activating period; and repeats this; and

(28) the data-sending module carries out, by giving predetermined data to the screen module via the data-sending means: a first-color activating process for extracting, from the image data in the frame memory, the first-color gradation data for each pixel, distributing the gradation data to the gradation-control circuit of each pixel, and activating the first-color LED(s) of each pixel for a predetermined time in a unison; a second-color activating process for extracting, from the image data in the frame memory, the second-color gradation data for each pixel, distributing the gradation data to the gradation-control circuit of each pixel, and activating the second-color LED(s) of each pixel for a predetermined time in a unison; and a third-color activating process for extracting, from the image data in the frame memory, the third-color gradation data for each pixel, distributing the gradation data to the gradation-control circuit of each pixel, and activating the third-color LED(s) of each pixel for a predetermined time in a unison.

Fourth Invention

A fullcolor LED display system according to the fourth invention is characterized in that the high-speed pulse-train generating means in the data-sending module comprises: a waveform memory having stored therein digital data in which the pulse trains are expressed as a static binary waveform pattern; and a memory-data-reading means for repetitively generating, with a constant period, high-speed pulse trains of ($2^n$) pieces or a number closely therebelow, wherein pulse intervals vary with time according to the varying characteristic having been set, by read-accessing the waveform memory at a predetermined speed and in a predetermined order, and outputting, in series, digital data of the binary waveform pattern.

Fifth Invention

A fullcolor LED display system according to the fifth invention is characterized in that the data-sending module comprises a characteristic-varying means for changing the varying characteristic of the high-speed pulse trains by rewriting the data in the waveform memory.

Sixth Invention

A fullcolor LED display system according to the sixth invention is characterized in that the high-speed pulse-train generating means in the data-sending module comprises a function-arithmetic-operation means for repetitively generating, with a constant period, the high-speed pulse trains by conducting, at high speed, a function-arithmetic operation according to a program in which a time, until a succeeding pulse Pi+1 is output after a pulse Pi has been output, is expressed as a function of i.

Seventh Invention

A fullcolor LED display system according to the seventh invention is characterized in that the data-sending module comprises a characteristic-varying means for changing the varying characteristic of the high-speed pulse trains by changing the function having been programmed to the function-arithmetic-operation means.

Eighth Invention

A fullcolor LED display system according to the eighth invention is characterized in that the data-sending module has a plurality of characteristic information, which defines the varying characteristic of the high-speed pulse trains, having been preset thereto; and that the characteristic-varying means includes a characteristic-switching means for selectively adopting the characteristic information having been preset.

Ninth Invention

A fullcolor LED display system according to the ninth invention is characterized in that the data-sending module comprises: an analyzing means for carrying out an analysis, according to an appropriate algorithm, a gradation-expression characteristic of image data to be displayed on the screen module; and a changing means for appropriately changing the varying characteristic of the high-speed pulse trains, by the characteristic-varying means, according to a result of the analysis.

Tenth Invention

A fullcolor LED display system according to the tenth invention is characterized in that the data-sending module comprises a changing means for appropriately changing the varying characteristic of the high-speed pulse trains, by the characteristic-varying means, according to a predetermined control information attached to image data to be displayed on the screen module.

Eleventh Invention

A fullcolor LED display system according to the eleventh invention is characterized in that the data-sending module comprises a changing means which obtains information related to a condition of light ray to which the screen module is subjected, and which appropriately changes the varying characteristic of the high-speed pulse trains, by the characteristic-varying means, according to the information.

Twelfth Invention

A fullcolor LED display system according to the twelfth invention is characterized in that the data-sending module comprises a changing means which obtains information related such as to season, time of day, and climate, and which appropriately changes the varying characteristic of the high-speed pulse trains, by the characteristic-varying means, according to the information.

Thirteenth Invention

A fullcolor LED display system according to the thirteenth invention is characterized in that, as for a group of the LEDs with the same color in a plurality of pixels adjacently arranged on the screen, a group of the gradation-control circuits for the respective LEDs is integrated into one integrated circuit; and in the group of gradation-control circuits, one n-bit counter is shared among the respective gradation-control circuits.

BEST MODE FOR CARRYING OUT THE INVENTION

As an example of a full-color LED display system according to the present invention, explanation will be made on a screen module with a pixel configuration of 480 lines vertical×128 dots lateral, as was exemplified in the Background Art. Each of the pixel lamps of a total of 61,440 pieces is an LED-multicolor-assembled lamp having densely gathered LEDs in the three primary colors RGB. Pixel data for activating one pixel lamp is made of data of a total of 24 bits, 8 bits respectively for each RGB. Thus, a full-color expression in 16,777,216 colors is made possible. Image data for one screen is made of data of (61,440×24) bits. The image-data source is an NTSC video signal. A/D conversion of the analog video signal into digital image data is carried out for the respective RGB colors in 8 bits. The data is stored to a frame memory 2 of a data-sending module 1.

Pixel Lamps and Data Distribution

Figure 1:
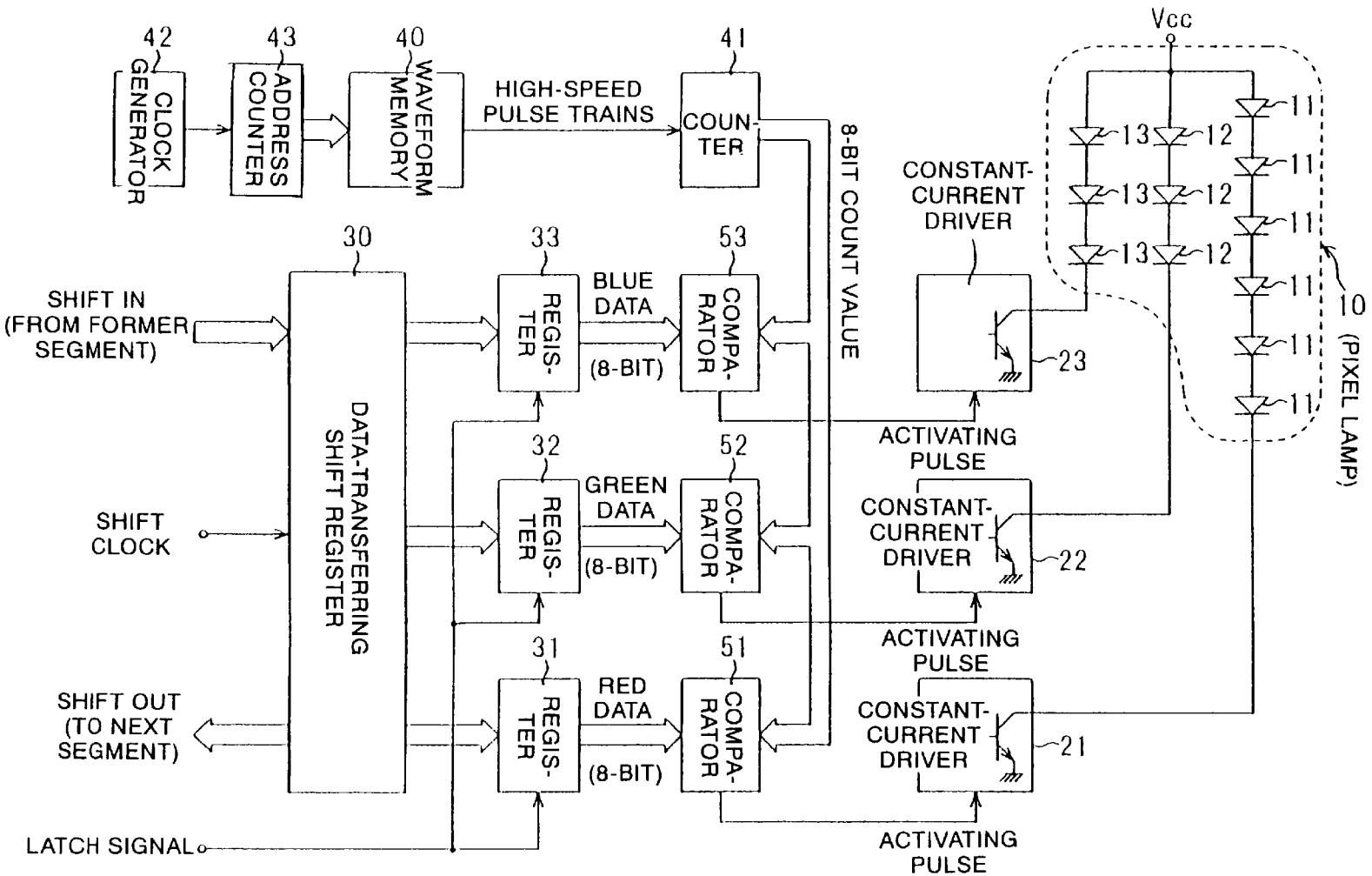
FIG. 1 is a structural diagram of one pixel lamp and its peripheral circuits according to one example of the present invention.
Figure 2:
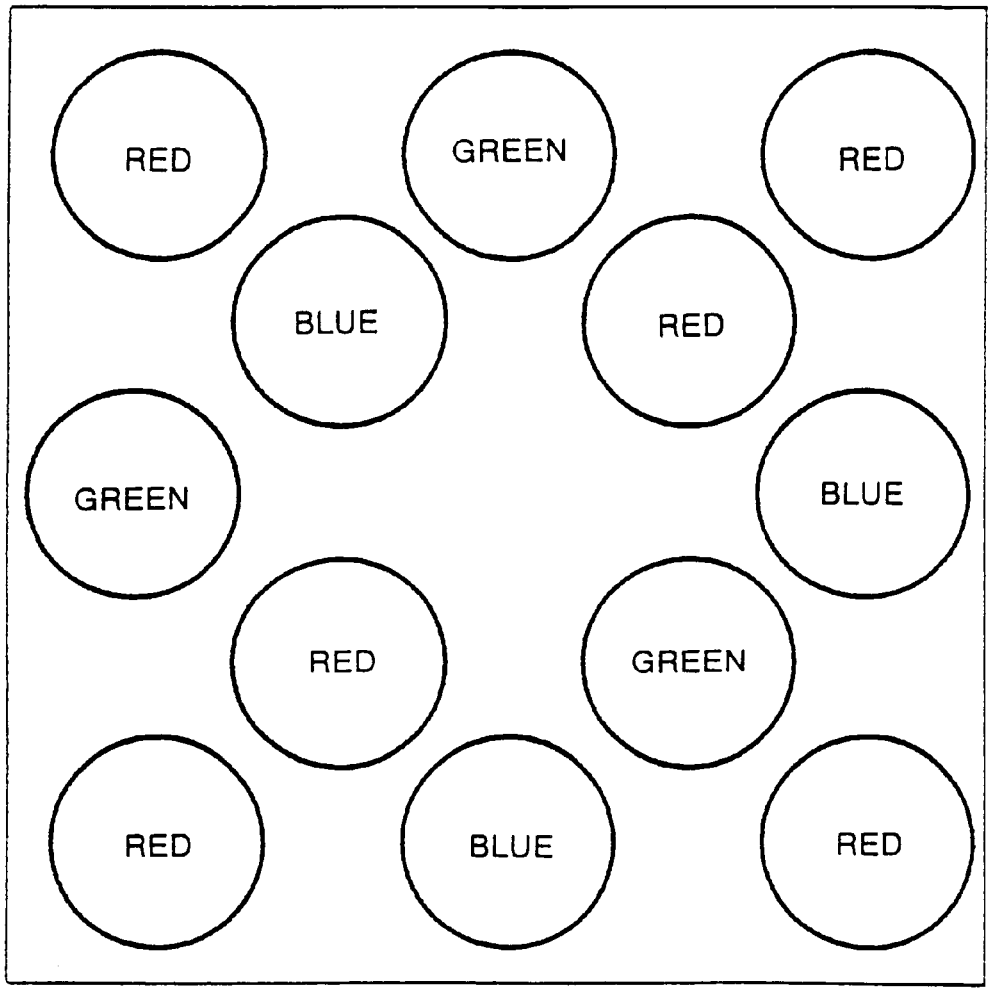
FIG. 2 is a diagram showing an arrangement example of each of the RGB LEDs in the above-mentioned one pixel lamp.

FIG. 1 and FIG. 2 show a configuration regarding one pixel lamp. One pixel lamp 10 is made by gathering and mixing six pieces of red LEDs 11, three pieces of green LEDs 12, and three pieces of blue LEDs 13. FIG. 2 shows an arrangement example of the twelve LEDs included in one pixel lamp 10.

As shown in FIG. 1, the red LEDs 11 are connected in series between a power source Vcc and a constant-current driver 21. The green LEDs 12 are connected in series between the power source Vcc and a constant-current driver 22. The blue LEDs 13 are connected in series between the power source Vcc and a constant-current driver 23. The data-sending module distributes and transfers to the 61,440 pieces of pixel-lamp-activating circuits (corresponding to the gradation-control circuits described above), at high speed, the image data for one screen provided in the frame memory. A shift register 30 in FIG. 1 is used for the data transferring.

The data-sending module 1 outputs, in series and at a high speed, the image data for one screen provided in the frame memory 2 in a predetermined order on an 8-bits basis, and sends the data to a data-distribution circuit 3. The data-distribution circuit 3 distributes image data, among the image data of one whole screen, corresponding to a pixel-lamp assembly of the respective 480 lines configuring the display screen. The lamp assembly of one line consists of 128 pieces of pixel lamps 10. Data-transferring shift registers 30 in the activating circuits of the 128 pieces of pixel lamps are connected in series, and a data-transfer line of shift registers with 8 bits×3 segments×128 pieces is configured.

When image data (gradation data of 8 bits for each red, green and blue color) corresponding to each of the 128 pieces of pixel lamps 10 is packed into the data-transfer line, a latch signal is applied to registers 31, 32, 33 in each of the pixel-lamp-activating circuit from the data-sending module 1, and the red data, green data and blue data, comprised respectively of 8 bits and provided in the data-transferring shift registers 30, are respectively latched to the registers 31, 32, 33.

Activating Control of Pixel Lamp

The red data, green data and blue data, comprised respectively of 8 bits and latched to the respective registers 31, 32, 33 are taken as data for determining a pulse width of an activating pulse for lighting and activating respective red LEDs 11, green LEDs 12, and blue LEDs 13 in a pixel lamp 10. Since the control system for the respective three colors RGB operate according to exactly the same mechanism, an explanation of the control system for red will be representatively made below.

The magnitude of the 8-bit gradation data A latched to the register 31 and an 8-bit count value B from a counter 41 is compared in a digital comparator 51. When $A \geqq B$, the output of the comparator 51 turns ON. This output from the comparator 51 becomes the activating pulse for a constant-current driver 21. During the ON period, an output transistor of the constant-current driver 21 turns ON and a constant current is passed through a series circuit of the red LEDs 11, and the LEDs are lighted.

The counter 41 is a 8-bit counter, and its 8-bit count value B changes from all "0" to all "1" repetitively with a constant period Ts. Thus, the activating pulse output from the comparator 51 has a period of Ts. The pulse width Tw of the activating pulse is determined, as explained below, corresponding to the binary value of the red data latched to the register 31. Note that a desirable frequency (1/Ts) of the activating pulse is about a few kHz.

High-speed Pulse Train

The count input, which activates the 8-bit counter 41, is a high-speed pulse train output from a waveform memory 40. In the waveform memory 40, there is stored digital data in which the 256 pulse trains, the pulse intervals thereof changing with time according to a varying characteristic having been set, are expressed as a static binary waveform pattern. An address space of the waveform memory 41 is repetitively scanned by an address counter 43 being stepped by a clock from a clock generator 42; whereby the 256 pulse trains, of which the pulse intervals are varied with time according to a predetermined varying characteristic, are repetitively output from the waveform memory 40 with the aforementioned period Ts.

Figure 4:
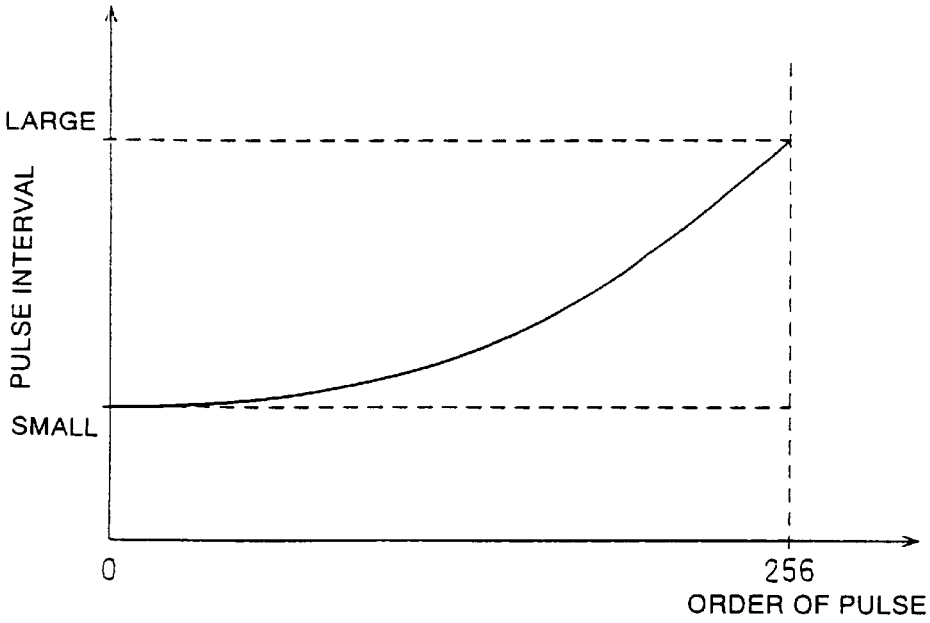
FIG. 4 is a graph showing a pulse-interval characteristic of high-speed pulse trains according to one example of the present invention

The pulse intervals of the high-speed pulse trains are set as follows. The pattern of the 256 pulse trains, which are orderly output from the waveform memory 40 with period Ts, is set so that the pulse intervals become gradually longer from the head towards the end of trains. This characteristic is shown as a graph in FIG. 4. In other words, in the beginning portion of the period Ts of the high-speed pulse trains, the pulse-generating frequency is high, whereas in the end portion, the pulse-generating frequency gradually becomes low.

Figure 5:
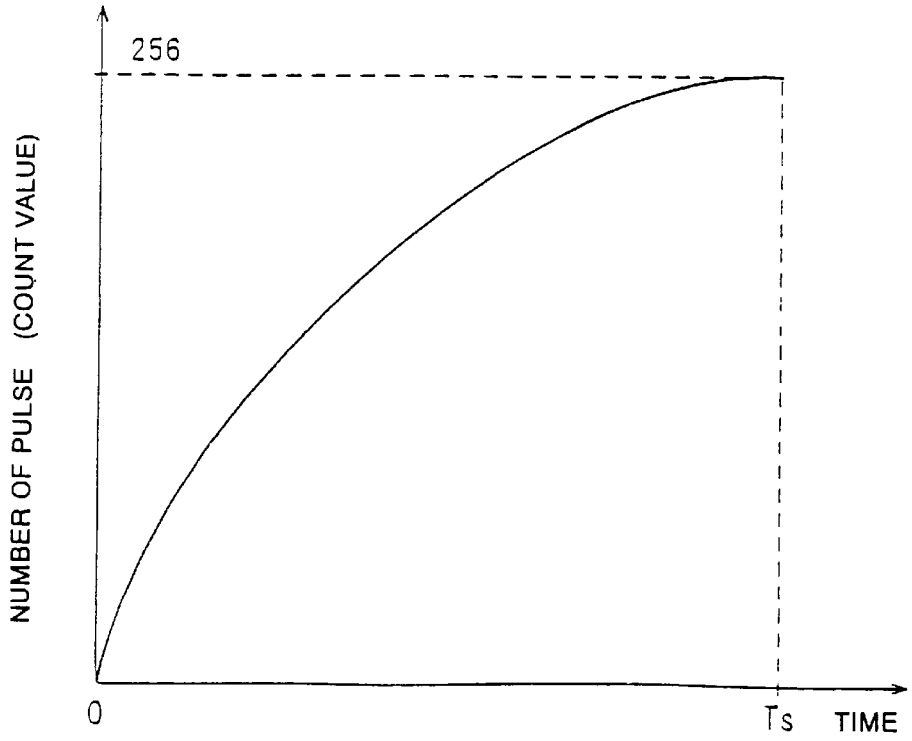
FIG. 5 is a graph showing a time-varying characteristic of count values of the above-mentioned high-speed pulse trains.

The high-speed pulse trains with the above-mentioned characteristic are taken as the count input of the 8-bit counter 41. Thus, the variation-with-time characteristic of the 8-bit count value B of the counter 41 is as shown in FIG. 5. In the beginning portion of the period Ts, the increasing rate is high, and as the period Ts heads towards the end, the increasing rate decreases.

Inverse-gamma Correction Characteristic

As mentioned above, although the 8-bit count value B of the counter 41 repetitively changes from all "0" to all "1" with a constant period Ts, the increasing rate of the value B is not constant, and in the beginning portion of the period Ts, the value changes at a high increasing rate, and as the period Ts heads towards the end, the increasing rate drops. Through magnitude comparison between the 8-bit count value B and the 8-bit gradation data A latched to the register 31, the pulse width Tw of the activating pulse is determined. Thus, the relation between the binary value A of the gradation data and the pulse width Tw will not have a linear, proportional characteristic.

Figure 6:
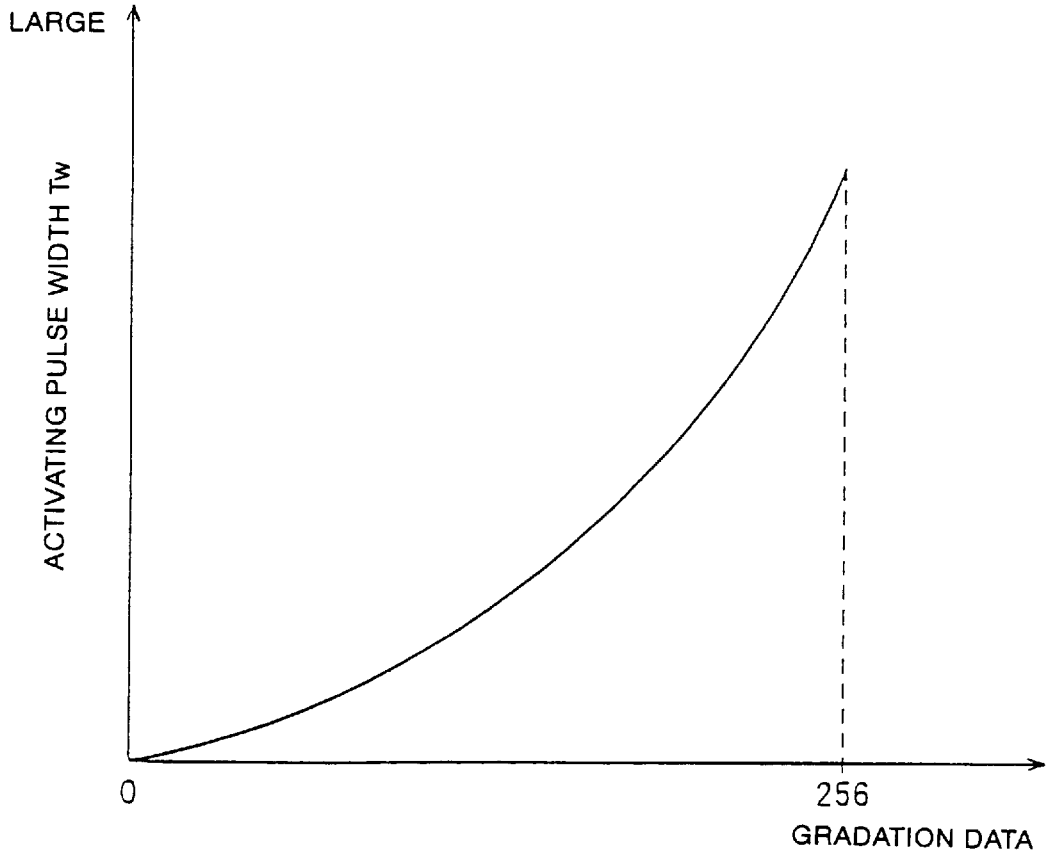
FIG. 6 is a graph showing a functional characteristic of gradation data and an activating-pulse width based on the above-mentioned high-speed pulse train.

When $A \geqq B$, the activating pulse turns ON. Thus, a shown in FIG. 6, as for the varying characteristic of the activating-pulse width Tw in view of the binary value A of the gradation data, in a region where the binary value A of the gradation data is small, the varying rate of the pulse width Tw is small, and as the value A becomes larger, the varying rate of the pulse width Tw also becomes larger. This nonlinearity is a characteristic approximate to the gamma characteristic of a CRT television set, and is the inverse-gamma correction characteristic for canceling the gamma-correction characteristic that has been previously applied to an NTSC video signal.

Location of the High-speed-pulse-train Source

Figure 3:
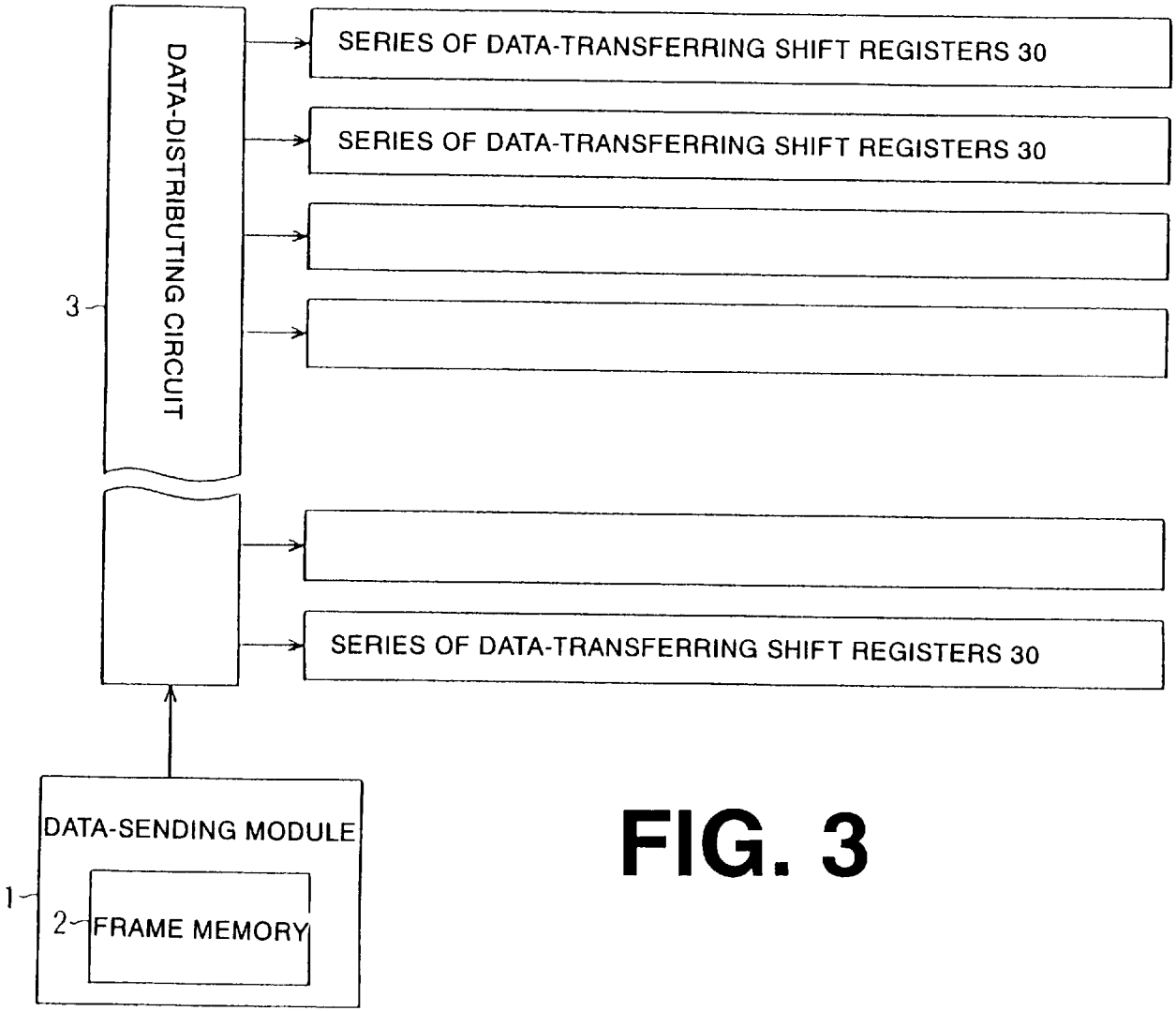
FIG. 3 is a schematic structural diagram of distributing-and-transferring system of image data according to one example of the present invention

As apparent from the above explanation, the high-speed pulse trains, which are output from the waveform memory 40, become a common signal for all of the pixel-lamp activating circuit of the screen module. The waveform memory 40, the address counter 43, and the clock generator 42 are installed to the data-sending module 1 shown in FIG. 3, and a configuration is provided in which the high-speed pulse trains are fed to each of the pixel-lamp activating circuits through the data-sending line connecting the data-sending module 1 and the screen module.

In the example of FIG. 1, the high-speed pulse train is a single-system signal common for each of the colors; and a configuration is provided in which the 8-bit count values, which are output from the 8-bit counter 41 that counts the high-speed pulse trains, are given in a common manner to the three digital comparators 51, 52, 53 provided for gradation control of red, green and blue colors. Therefore, what is fed from the data-sending module 1 to the screen module is only the high-speed pulse trains of a single-system; and thus, only one data-sending line needs to be assigned therefor. Consequently, the configuration of the circuit for sending and receiving signals, and the configuration of the data-sending line are extremely simple, and they can be implemented inexpensively.

Note that there are embodiments in which high-speed pulse trains, having different characteristics for the respective red, green and blue colors, are generated, and in which the high-speed pulse trains in three systems are sent in a parallel manner from the data-sending module 1 to the screen module. Since this mode provides an optimum nonlinear-pulse-width modulation for each of the three primary colors, it is possible to realize a more superior image quality. In this case too, there is only the need to assign three data-sending lines for sending, in a parallel manner, the high-speed pulse trains for red-color control, the high-speed pulse trains for green-color control and the high-speed pulse trains for blue-color control; and thus, the configuration is simple, and implementation is inexpensive.

Pixel-lamp-activating Circuit Made Into IC

As for the above-mentioned pixel-lamp-activating circuit (gradation-control circuit), a typical product made into an IC is used. With reference to FIG. 1, the typical IC-type activating circuit is, for example, a circuit having integrated: a data-transferring shift register 30 for 16 pixels; 16 pieces of registers 31, 32, 33 . . . for the 16 pixels; 16 pieces of comparators 51, 52, 53 . . . for the 16 pixels; 16 pieces of constant-current drivers 21, 22, 23 . . . for the 16 pixels; and one counter 41. This example is a preferred circuit structure for installing one activating circuit for activating one color of the 16 pixels adjacently arranged on the screen module. Three of the aforementioned ICs are made to correspond to the 16 pixels, and the three ICs are used separately for the respective red, green and blue colors. In this case, when the high-speed pulse trains are input to a predetermined input terminal of the aforementioned IC, the counter 41 within the IC counts the high-speed pulse trains, and the count value is input to the sixteen digital comparators within the IC.

Data Rewriting of Waveform Memory 40

A significant feature of the present invention is that it is possible to variably set, in a free manner, the functional characteristic of the gradation data A and the activating-pulse width Tw by virtue of the pulse-interval characteristic of the binary-wave pattern of the high-speed pulse trains stored in the waveform memory 40. Therefore, the present invention is not only beneficial for canceling a particular gamma-correction characteristic having been previously applied to an NTSC video signal, but is a technical idea having various applications.

For example, a configuration is made so that the waveform memory 40 is provided in the data-sending module 1, and that the contents of the memory 40 can be freely rewritten by a computer within the device. Then, by rewriting the data in the waveform memory 40 in view of a gradation-expression characteristic of an image data to be displayed, it is possible to realize high-quality display through appropriate gradation control for each image. Further, in the case where an LED display device is placed outside, by rewriting the data of the waveform memory 40 in view of change in peripheral light-ray conditions, such as between daytime and nighttime or according to seasons or climate, it is possible to realize high-quality display through appropriate gradation control according to circumstances. In these cases, many different data to be written to the waveform memory 40 will be provided, and these data will be selectively used.

Further, by specifically analyzing the characteristics of an activating current and optical output of the LEDs being used, it is possible to accurately realize a correction characteristic which exactly matches the analyzed characteristics by the data of the waveform memory 40. Here, it may be considered that the lighting characteristic may differ between the red LED, green LED and blue LED. In this case, separate waveform memories 40 and counters 41 for respective control systems for each of the colors will be provided, and count values B, respectively having different increasing characteristics, will be generated and fed to the digital comparators for each of the colors.

Arithmetic Operation Output of High-speed Pulse Train

In the above example, ($2^n$) pieces of high-speed pulse trains, of which the pulse intervals are varied with time according to a predetermined varying characteristic, are repetitively generated with a constant period Ts by outputting, in series and at a predetermined speed, digital data recorded in the waveform memory 40. Such structure can be replaced by a circuit means as follows.

In order to define a characteristic of pulse intervals of the high-speed pulse trains which are varied with time, an arithmetic equation is made in which a time, until a succeeding pulse Pi+1 is output after a pulse Pi has been output, is expressed as a function of i. According to this arithmetic equation, a process of repetitively generating ($2^n$) of high-speed pulse trains with a constant period of TS is realized by a computer program. For example, after outputting a first pulse, a pulse-interval value between the first and second pulses, which is obtained through arithmetic operation, is set to and counted down by a timer; then, after this value comes down to zero, the second pulse is output; and then, a pulse-interval value between the second and third pulses, which is obtained through arithmetic operation, is set to and counted down by a timer; and after this value comes down to zero, the third pulse is output. Such an operation may be repetitively implemented by a program process. When adopting such a method, alike the aforementioned waveform-memory method, it is possible to easily change the setting to various characteristics by changing the aforementioned arithmetic equation. It is of course possible to conduct this arithmetic-operation-output process by a dedicated circuit.

Embodiment of Third Invention

Figure 7:
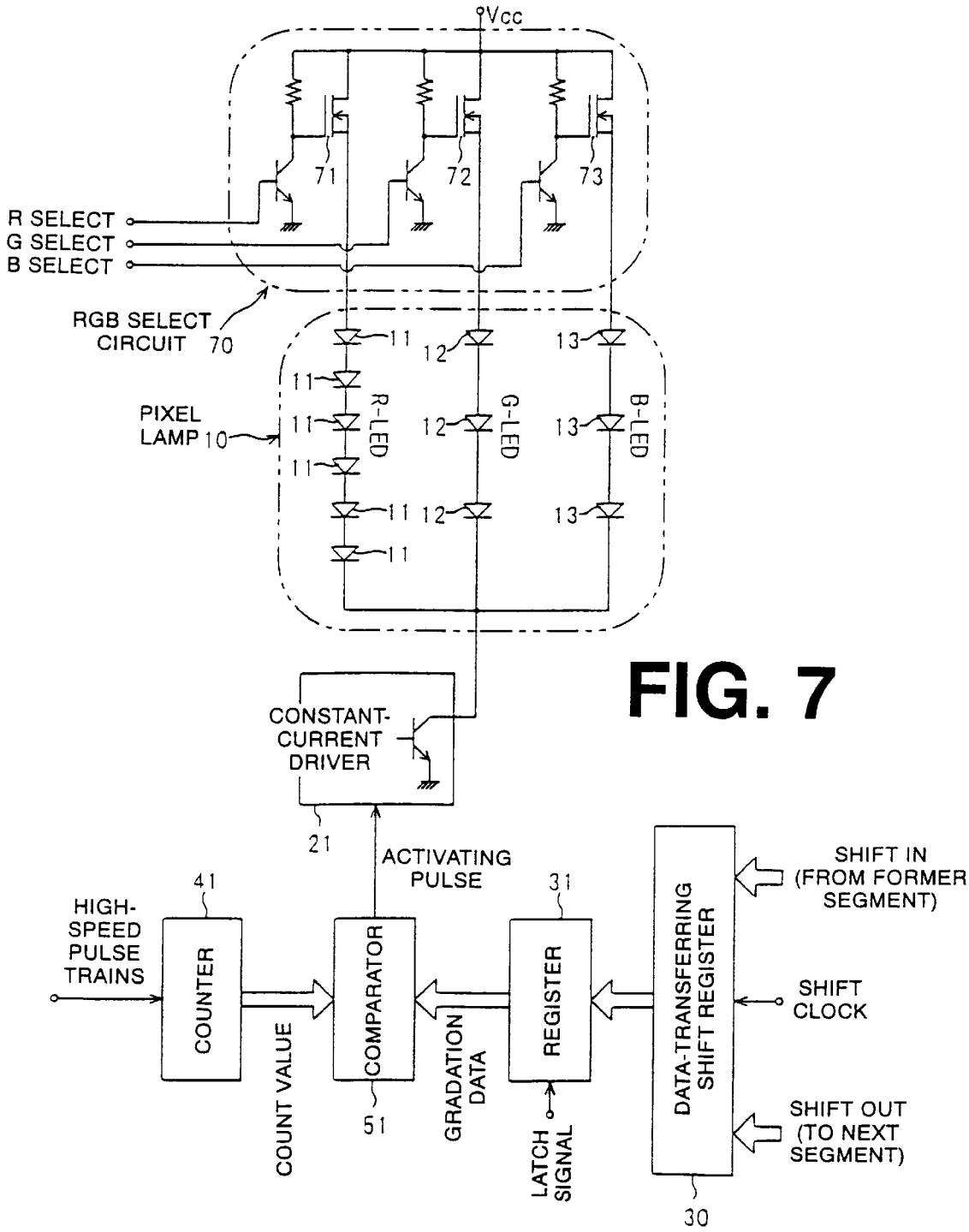
FIG. 7 is a structural diagram of one pixel lamp and its peripheral circuits according to another example of the present invention.
Figure 8:
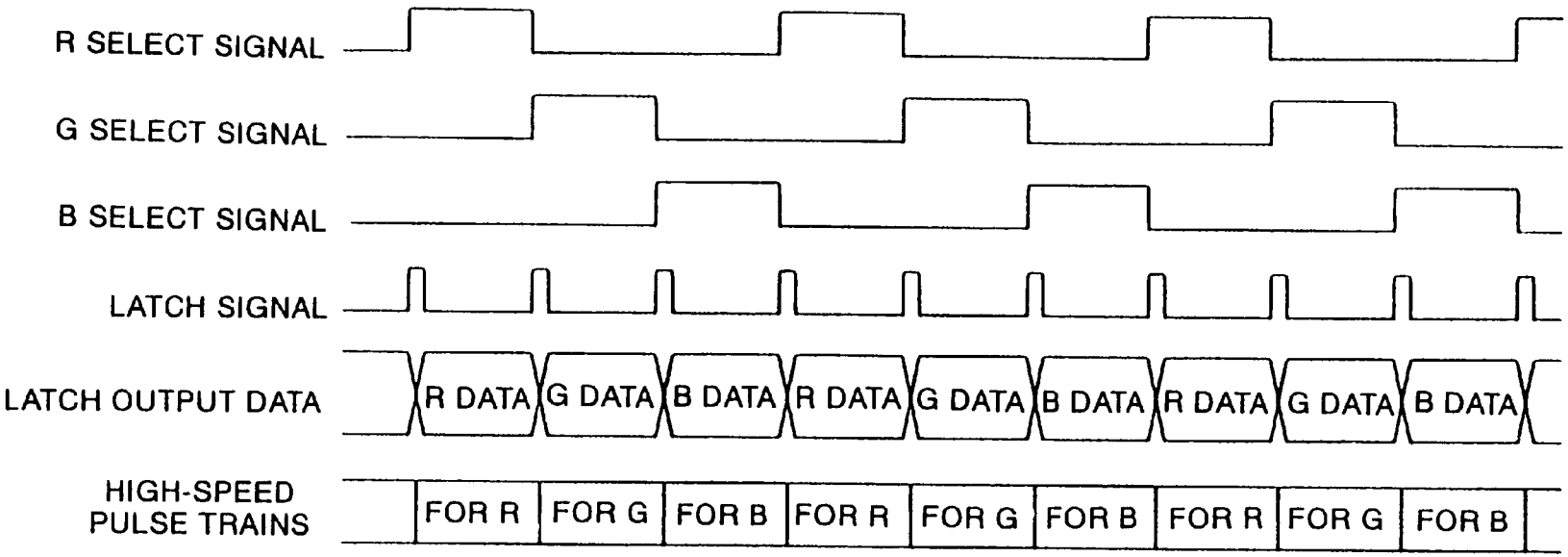
FIG. 8 is a timing chart showing a pixel-lamp activating method according to the example of FIG. 7.

FIG. 7 and FIG. 8 show the main points of an embodiment of the third invention. Alike the above-mentioned example, a total of 61,440 pieces of pixel lamps are orderly arrayed in a screen module. One pixel lamp 10 is an assembled lamp in which six red LEDs 11, three green LEDs 12 and three blue LEDs 13 are densely gathered. Pixel data for driving one pixel is data consisting of a total of 24 bits, 8 bits respectively for each RGB; and a fullcolor expression of 16,777,216 colors is made possible. The image data for one whole screen is data of (61,440×24) bits.

As shown in FIG. 7, the six red LEDs 11, the three green LEDs 12 and the three blue LEDs 13 in one pixel lamp 10 are connected in series on a color-by-color basis. The cathode sides of the LED-series connections for the respective colors are connected to an open-collector output of a constant-current driver 21 through a common connection. The anode sides of the LED-series connections for the respective colors are connected to a power source Vcc via a red switch 71, green switch 72 and blue switch 73 of an RGB-select circuit 70. The constant-current driver 20 and the RGB-select circuit 70 operate, as follows, according to a signal given from the data-sending module 1 (see FIG. 3), and lights and activates the pixel lamp 10.

FIG. 8 shows a timing relation of signals given to the pixel-lamp-activating circuit of the screen module and to the RGB-select circuit 70 from the data-sending module 1.

To the RGB-select circuit 70 are given a red-select signal for turning ON the red switch 71, a green-select signal for turning ON the green switch 72, and a blue-select signal for turning ON the blue switch 73. These select signals are made, in the screen module, by the aforementioned data-transfer clock or the latch signal. As is clearly shown in FIG. 8, the red switch 31, the green switch 32 and the blue switch 33 are selectively, orderly and repetitively turned ON respectively for a constant time.

To the 8-bit register is given a latch signal being in synchronism with the switching of the RGB-select signals, and is given image data via the data-transferring shift register 30. Right before the red-select signal turns ON, an 8-bit red data is transferred and latched to a latch circuit 31. The 8-bit red data being output from the latch circuit 31 is input to the digital comparator 51. To the other input of the comparator 51 is applied an 8-bit count value from a 8-bit counter 41. Here, the high-speed pulse trains being input to the counter 41 from the data-sending module 1 are pulse trains for red-gradation control having a nonlinear characteristic. The comparison output of the comparator 51 is an activating pulse which is input to the constant-current driver 21, and the red LEDs 11 are lighted in response to the activating pulse.

Next, right before the green-select signal turns ON, an 8-bit green data is transferred and latched to the latch circuit 31. Here, the high-speed pulse trains being input to the counter 41 from the data-sending module 1 are pulse trains for green-gradation control having a nonlinear characteristic. The comparison output of the comparator 51 is an activating pulse which is input to the constant-current driver 21, and the green LEDs 12 are lighted in response to the activating pulse.

Next, right before the blue-select signal turns ON, an 8-bit blue data is transferred and latched to the latch circuit 31. Here, the high-speed pulse trains being input to the counter 41 from the data-sending module 1 are pulse trains for blue-gradation control having a nonlinear characteristic. The comparison output of the comparator 51 is an activating pulse which is input to the constant-current driver 21, and the blue LEDs 13 are lighted in response to the activating pulse.

The above-mentioned operation is repeated at high speed. For example, a period, in which a turning-ON operation of the red switch 71, green switch 72 and blue switch 73 makes a turnaround, is set at 1/60 second. That is, the time in which one switch is turned on is 1/180 second.

In one pixel lamp comprised by gathering red LEDs, green LEDs and blue LEDs, even with the method of the present invention in which the red-activating time, the green-activating time and the blue-activating time are time-divided at high speed, the additive-color process is performed in a superior manner, and it is possible to realize an image display of sufficiently high-quality from the viewpoint of time-space characteristic in relation to chromaticity. Note that the present invention is similarly effective as the above description in pixel configuration wherein the red LEDs, green LEDs and blue LEDs are evenly dispersed and arranged throughout the whole display surface of the screen.

As for time-space characteristic in view of luminance, a comparison will be made between the 1/3-dynamic-activating method of the present example, and a conventional 1/3-dynamic-activating method according to simple line selection. In the method of the present invention, all of the pixel lamps constructing the display screen are simultaneously lighted, whereas in the conventional method, the pixel lamps that are simultaneously lighted are ⅓ of the whole number. Thus, the present invention is advantageous and superior in terms of flickering-sense and resolution. As for circuit structure, it can be said that basically there is no superiority or inferiority between the method of the present example and conventional method, if it is the same ⅓-dynamic-activating method. According to the present invention, an image display of a higher quality than before can be realized with almost the same burden in circuit structure.

In terms of circuit structure, a comparison will be made between the ⅓-dynamic-activating method of the present example, and a conventional ⅓-dynamic-activating method according to simple line selection. An assumption is made that a white color with high luminance is displayed on the whole screen of both the devices. According to the method of the present invention, there is no period in which, for example, the red LEDs, green LEDs and blue LEDs of the 128 pieces of pixel lamps forming one line are lighted in unison, and only the LEDs of one color among red, green and blue are lighted at a moment. On the contrary, in the conventional method, even though one line out of three lines are orderly lighted, the red LEDs, green LEDs and blue LEDs of the 128 pieces of pixel lamps forming the lighted line are all lighted in unison.

The total amount of electric power for activation in both methods is, of course, the same; however, when viewing the instantaneous value of activating current being fed to one line, the current for the method of the present invention is ⅓ compared to that of the conventional method. This signifies that the configuration of a power-source device and power-source-feeding system for each of the lines in the present invention is managed with a small capacity and simple structure. This requirement is not so important in compact LED-multicolor-display devices, but when configuring a high-luminance LED-multicolor-display device for outside use having a super-large-size screen, it becomes an extremely realistic and important technical requirement. The present invention is superior in this aspect.

Further, in the examples shown in FIG. 7 and FIG. 8, since time-divided transferring of high-speed pulse trains for red-gradation control, high-speed pulse trains for green-gradation control, and high-speed pulse trains for blue-gradation control is carried out using a data-sending line of a single-system, high-speed pulse train. Thus, gradation control of an extremely high-performance can be realized by an extremely simple configuration.

What is claimed is:

1. A full-color LED display system comprising:

a screen module for displaying a multicolor image on a screen in which a multitude of first-color LEDs, second-color LEDs and third-color LEDs are orderly arrayed; and a data-sending module which is connected with the screen module via data-sending means, and which gives a control signal as well as image data, the image data being an assembly of gradation data for each colors of each pixels on the screen;

on the screen module, there are installed: first-color gradation-control circuits, second-color gradation-control circuits and third-color gradation-control circuits respectively for each pixel on the screen for pulse-lighting the LEDs; data-transferring shift registers for giving the gradation data to the respective first-color gradation-control circuits, second-color gradation-control circuits and third-color gradation-control circuits; and one or a plurality of data-distributing circuits for distributing the gradation data given from the data-sending module to the data-transferring shift registers;

the first-color gradation-control circuit, the second-color gradation-control circuit and the third-color gradation-control circuit comprise: an n-bit counter for counting high-speed pulse trains given from the data-sending module; a register for latching the gradation data given from the data-transferring shift register; a digital comparator for comparing magnitude between an n-bit count value from the n-bit counter and the gradation data latched to the register; and a constant-current driver for turning ON and OFF a current-passing to the LED according to a binary output or the digital comparator;

the data-sending module comprises: a frame memory for temporarily storing image data to be displayed by the screen module; means for reading out the image data from the frame memory, and successively sending, to the screen module, the image data in a predetermined pixel order; first-color high-speed pulse-train generating means, second-color high-speed pulse-train generating means, and third-color high-speed pulse-train generating means for generating high-speed pulse trains to be given to the respective first-color gradation-control circuit, second-color gradation-control circuit and third-color gradation-control circuit; and means for sending, towards the screen module, the respective high-speed pulse trains for the respective first color, second color and third color;

in the screen module, the gradation data for each colors of each pixels successively given from the data-sending module is respectively fed to the register in the gradation-control circuit for the corresponding color in the corresponding pixel via the data-transferring shift register and the data-distributing circuit; and the first-color high-speed pulse trains, the second-color high-speed pulse trains and the third-color high-speed pulse trains, given from the data-sending module, are respectively fed as a count input to the n-bit counter in the gradation-control circuit of the corresponding color; and the high-speed pulse-train generating means for the first color, the second color and the third color in the data-sending module repetitively generate, with a constant period, high-speed pulse trains of $2^n$ pieces or a number closely therebelow, of which pulse intervals vary with time according to a varying characteristic having been set; and comprise: a waveform memory storing digital data in which the pulse trains are expressed as a static binary waveform pattern; and memory-data-reading means for repetitively generating, with a constant period, the high-speed pulse trains by read-accessing the waveform memory at a predetermined speed and in a predetermined order, and outputting, in series, the digital data of the binary waveform pattern.

2. A fullcolor LED display system according to claim 1, characterized in that:

the first-color high-speed pulse-train generating means, the second-color high-speed pulse-train generating means, and the third-color high-speed pulse-train generating means are replaced by a single-system high-speed pulse-train generating means which is shared among process systems for tho first color, second color and third color; and the data-sending module sends the single-system high-speed pulse train towards the screen module.

3. A fullcolor LED display system comprising:

a screen module for displaying a multicolor image on a screen in which a multitude of first-color LEDs, second-color LEDs and third-color LEDs are orderly arrayed; and a data-sending module which is connected with the screen module via data-sending means, and which gives a control signal as well as image data, the image data being an assembly of gradation data for each colors of each pixels on the screen:

on the screen module, there are installed: one or a plurality of color-select circuits for selecting LEDs of one color among a set of first-color LED(s), second-color LED(s) and third-color LED(s) forming a same pixel on the screen; gradation-control circuits which are allotted respectively to each set of first-color LED(s), second-color LED(s) and third-color LED(s) forming a same pixel on the screen, for pulse-lighting the LED(s) with color selected by the color-select circuit; data-transferring shift registers for giving the gradation data to the gradation-control circuits; and one or a plurality of data-distributing circuits for distributing the gradation data given from the data-sending module to the data-transferring shift registers;

the gradation-control circuit comprises: an n-bit counter for counting high-speed pulse trains given from the data-sending module; a register for latching the gradation data given from the data-transferring shift register; a digital comparator for comparing magnitude between an n-bit count value from the n-bit counter and the gradation data latched to a register; and a constant-current driver for turning ON and OFF a current-passing to the LED according to a binary output of the digital comparator;

the first-color LED(s), the second-color LED(s) and the third-color LED(S) of the same pixel are connected in parallel to the constant-current driver via the select circuit;

the data-sending module comprises: a frame memory for temporarily storing image data to be displayed by the screen module; means for orderly reading out first-color gradation data, second-color gradation data and third-color gradation data within the image data from the frame memory, and successively sending, to the screen module, the data in a predetermined pixel order; high-speed pulse-train generating means for generating high-speed pulse trains to be given to the gradation-control circuit; and means for sending the high-speed pulse trains towards the screen module;

in the screen module: the gradation data, which is for each colors for each pixels given from the data-sending module, is fed to the register in the gradation-control circuit for the corresponding pixel via the data-transferring shift register and the data-distributing circuit; and the high-speed pulse trains, given from the data-sending module, are fed as a count input to the n-bit counter in the gradation-control circuit;

the screen module comprises means for controlling the color-select circuit in synchronism with the image data given from the data-sending module, and lighting and activating the first-color LEDs according to the first-color gradation data in a first-color activating period, and lighting and activating the second-color LEDs according to the second color gradation data in a second-color activating period, and lighting and activating the third-color LEDs according to the third-color gradation data in a third-color activating period, divided-time intervals of the first-color activating period, the second-color activating period and the third-color activating period are set to be a short time to an extent in which human sight cannot recognize that the three colors are lighted with a time difference;

the high-speed pulse-train generating means is means for orderly generating, with a constant period, high-speed pulse trains of $2^n$ pieces or a number closely therebelow, of which pulse intervals vary with time according to a varying characteristic having been separately set for each color, and repeating this, in the respective first-color activating period, the second-color activating period and the third-color activating period; and comprises: a waveform memory storing digital data in which the pulse trains are expressed as a static binary waveform pattern; and memory-data-reading means for repetitively generating, with a constant period, the high-speed pulse trains by read-accessing the waveform memory at a predetermined speed and in a predetermined order, and outputting, in series, the digital data of the binary waveform pattern.

4. A fullcolor LED display system according to claim 1, characterized in that a structure of the high-speed pulse-train generating means in the data-sending module is replaced by function-arithmetic-operation means for repetitively generating, with a constant period, the high-speed pulse trains by conducting, at high speed, a function-arithmetic operation according to a program in which a time, until a succeeding pulse Pi+1 is output after a pulse Pi has been output, is expressed as a function of i.

5. A fullcolor LED display system according to claim 4, characterized in that the data-sending module comprises characteristic-varying means for changing the varying characteristic of the high-speed pulse trains by changing the function having been programmed to the function-arithmetic-operation means.

6. A fullcolor LED display system according to claim 1, characterized in that, as for a group of the LEDS with a same color in a plurality of pixels adjacently arranged on the screen, a group of the gradation-control circuits for the respective LEDS is integrated into one integrated circuit; and in the group of gradation-control circuits, one n-bit counter is shared amount the respective gradation-control circuits.

* * * * *

UNITED STATES PATENT AND TRADEMARK OFFICE

CERTIFICATE OF CORRECTION

PATENT NO. : 6,734,875 B1
DATED : May 11, 2004
INVENTOR(S) : Tokimoto et al.

It is certified that error appears in the above-identified patent and that said Letters Patent is hereby corrected as shown below:

Column 16,
Line 17, please change “or” to -- of --.

Column 17,
Line 2, please change “tho” to -- the --.

Signed and Sealed this

Second Day of November, 2004

JON W. DUDAS
*Director of the United States Patent and Trademark Office*